US009664339B2

(12) United States Patent
Bittinger et al.

(10) Patent No.: US 9,664,339 B2
(45) Date of Patent: May 30, 2017

(54) SEMICONDUCTOR INCANDESCENT LAMP RETROFIT LAMP

(75) Inventors: Andreas Bittinger, Ulm (DE); Marc Luennemann, Munich (DE); Sascha Zelt, Ulm (DE)

(73) Assignee: OSRAM GMBH, Munich (DE)

( * ) Notice: Subject to any disclaimer, the term of this patent is extended or adjusted under 35 U.S.C. 154(b) by 323 days.

(21) Appl. No.: 14/110,466

(22) PCT Filed: Mar. 27, 2012

(86) PCT No.: PCT/EP2012/055374

§ 371 (c)(1),
(2), (4) Date: Oct. 8, 2013

(87) PCT Pub. No.: WO2012/139880

PCT Pub. Date: Oct. 18, 2012

(65) Prior Publication Data

US 2014/0029285 A1 Jan. 30, 2014

(30) Foreign Application Priority Data

Apr. 11, 2011 (DE) ..... 10 2011 007 123

(51) Int. Cl.
*F21S 8/10* (2006.01)
*F21K 99/00* (2016.01)
(Continued)

(52) U.S. Cl.
CPC ..... *F21K 9/10* (2013.01); *F21K 9/20* (2016.08); *F21K 9/232* (2016.08); *F21K 9/61* (2016.08);
(Continued)

(58) Field of Classification Search
CPC ... F21K 9/10; F21K 9/135; F21K 9/52; F21K 9/16; F21K 9/05; F21S 48/115;
(Continued)

(56) References Cited

U.S. PATENT DOCUMENTS 5,535,230 A * 7/1996 Abe ..... F21K 9/00 250/504 R
6,350,041 B1 * 2/2002 Tarsa ..... F21K 9/00 257/E33.072
(Continued)

FOREIGN PATENT DOCUMENTS

CH 700967 A1 11/2010
CN 201032076 Y 3/2008
(Continued)

OTHER PUBLICATIONS

Chinese Office Action based on Application No. 201280017971.6(9 Pages and 5 Pages of English translation) dated May 21, 2015 (Reference Purpose Only).
(Continued)

*Primary Examiner* — Andrew Coughlin
*Assistant Examiner* — Zheng Song
(74) *Attorney, Agent, or Firm* — Viering, Jentschura & Partner mbB

(57) ABSTRACT

A semiconductor incandescent lamp retrofit lamp may include: at least one semiconductor light source, at least one light scattering body, and at least one optical waveguide, into which light of the at least one semiconductor light source can be coupled, wherein the at least one light scattering body is configured and arranged for the purpose of diffusely emitting light supplied thereto from the at least one semiconductor light source by way of the at least one optical waveguide.

5 Claims, 1 Drawing Sheet

(51) Int. Cl.

| | |
|---|---|
| ***F21K 9/20*** | (2016.01) |
| ***F21K 9/232*** | (2016.01) |
| ***F21K 9/61*** | (2016.01) |
| *F21Y 101/00* | (2016.01) |

(52) U.S. Cl.
CPC ..... *F21S 48/1109* (2013.01); *F21S 48/1159* (2013.01); *F21S 48/147* (2013.01); *F21S 48/115* (2013.01); *F21S 48/1241* (2013.01); *F21V 2200/10* (2015.01); *F21V 2200/13* (2015.01); *F21Y 2101/00* (2013.01)

(58) Field of Classification Search
CPC F21S 48/1168–48/1181; F21S 48/1177; F21S 48/1159; F21S 48/1241; Y21O 1/02; Y21O 1/0266
USPC ..... 362/249.02, 311.01, 311.02, 511, 555, 362/558
See application file for complete search history.

(56) References Cited

U.S. PATENT DOCUMENTS

| | | | | |
|---|---|---|---|---|
| 2003/0081431 | A1* | 5/2003 | Brunfeld | G02B 6/0008 362/582 |
| 2006/0012984 | A1* | 1/2006 | Coushaine | F21K 9/00 362/227 |
| 2009/0290372 | A1 | 11/2009 | Kotajima et al. | |
| 2010/0060160 | A1* | 3/2010 | Auer | H01K 9/08 313/569 |
| 2010/0097821 | A1* | 4/2010 | Huang | F21K 9/52 362/555 |
| 2010/0213809 | A1* | 8/2010 | Roehl | F21S 48/1159 313/46 |
| 2011/0266939 | A1* | 11/2011 | Wang | F21K 9/52 313/116 |
| 2012/0014111 | A1* | 1/2012 | Welten | F21K 9/52 362/296.08 |
| 2012/0147624 | A1* | 6/2012 | Li | F21K 9/135 362/609 |

FOREIGN PATENT DOCUMENTS

| | | | |
|---|---|---|---|
| CN | 101596880 | A | 12/2009 |
| EP | 1610054 | A2 | 12/2005 |
| JP | 2002208305 | A | 7/2002 |
| WO | 0140702 | A1 | 6/2001 |
| WO | 2010079436 | A1 | 7/2010 |
| WO | 2010110652 | A1 | 9/2010 |

OTHER PUBLICATIONS

Chinese Office Action (including Chinese Search Report) based on application No. 201280017971.6 (9 pages and 5 pages of English translation) dated Jul. 18, 2016.

* cited by examiner

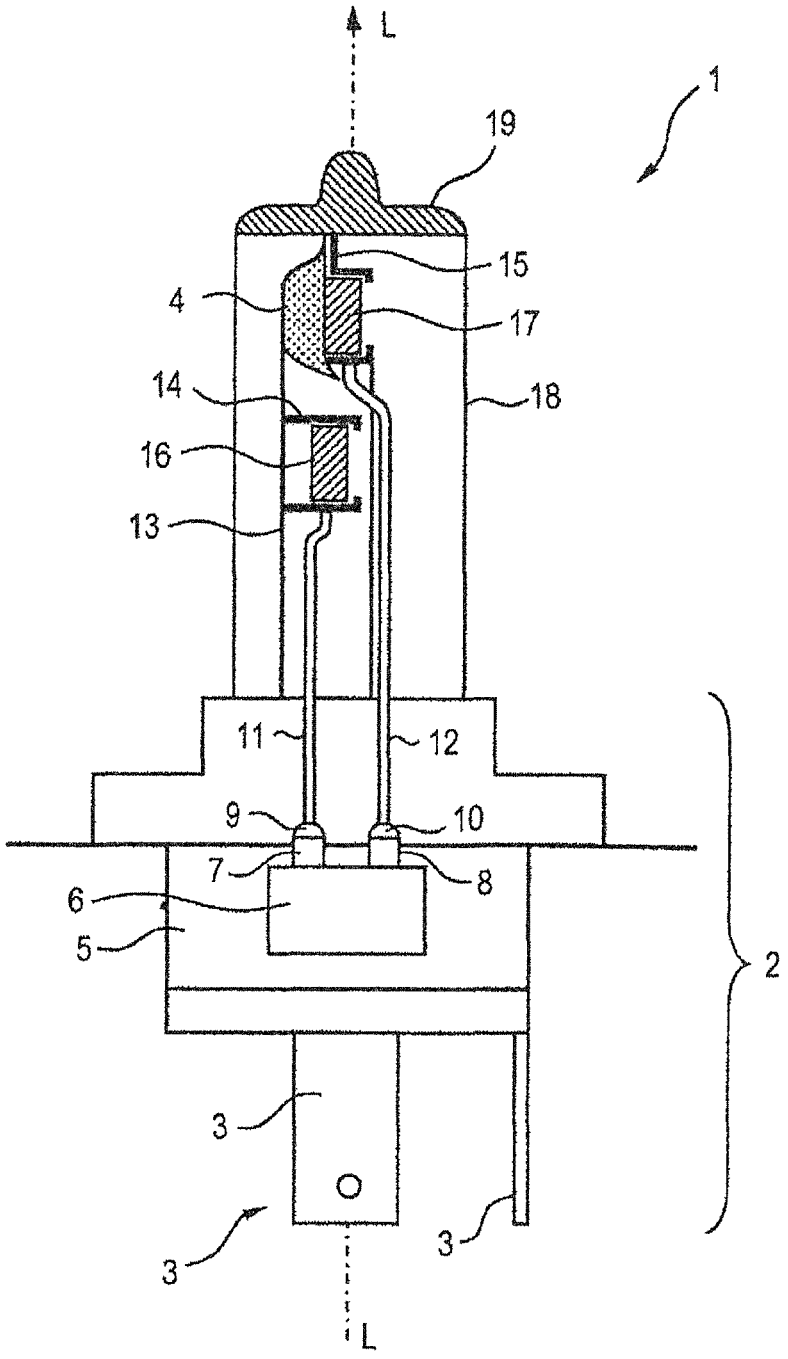
L
1
19
15
4
17
14
18
16
13
11
12
9
10
7
8
6
5
2
3
3
3
L

SEMICONDUCTOR INCANDESCENT LAMP RETROFIT LAMP

RELATED APPLICATIONS

This application is a national stage entry according to 35 U.S.C. §371 of PCT application No.: PCT/EP2012/055374 filed on Mar. 27, 2012, which claims priority from German application No.: 10 2011 007 123.7 filed on Apr. 11, 2011.

TECHNICAL FIELD

Various embodiments relate to a semiconductor incandescent lamp retrofit lamp, which has at least one semiconductor light source. The term semiconductor incandescent lamp retrofit lamp designates a lamp which has semiconductor light sources, for example, light-emitting diodes or laser diodes, and is equipped with a typical base for incandescent lamps and is implemented such that it is operable as a replacement for an incandescent lamp in an incandescent lamp socket.

BACKGROUND

LED incandescent lamp retrofit lamps for replacing conventional household incandescent lamps are known, which have a plurality of light-emitting diodes (LEDs). The attempt is made to deflect the light emitted in an oriented manner by the light-emitting diodes, by a three-dimensional alignment of the light-emitting diodes, by reflectors, or by diffusely scattering covers, as uniformly as possible and at the largest possible angle into the room (omnidirectional light emission pattern of the LED incandescent lamp retrofit lamps).

A semiconductor incandescent lamp retrofit lamp for replacing a conventional household incandescent lamp is known from WO 2006/035349 A2, which has at least one light-emitting diode, which couples its light into an optical fiber used simultaneously as a light scattering body. The optical fiber is used for the purpose of diffusely emitting the light coupled into it from the at least one light-emitting diode. The optical fiber is implemented like a coil in its center to simulate a light emission pattern of the conventional household incandescent lamp.

In motor vehicle headlights, efforts have been made to replace conventional headlights, which typically have halogen headlight lamps as light sources, by way of LED retrofit headlights.

SUMMARY

Various embodiments provide an improved possibility for the use of semiconductor light sources instead of incandescent lamps, in particular for vehicles.

Various embodiments provide a semiconductor incandescent lamp retrofit lamp, having at least one semiconductor light source, at least one light scattering body, and at least one optical waveguide, wherein light of the at least one semiconductor light source can be coupled into the optical waveguide and wherein the at least one light scattering body is configured and arranged for the purpose of (at least substantially) diffusely emitting the light supplied thereto from the at least one semiconductor light source by way of the at least one optical waveguide. The light from the at least one semiconductor light source is in particular substantially completely coupled into the at least one light scattering body. The at least one optical waveguide is therefore provided in particular as a light guiding means from the at least one semiconductor light source to the at least one light scattering body and in particular is not provided for the purpose of being used itself as a light scattering body.

This semiconductor incandescent lamp retrofit lamp has the advantage that it does not require complex alignment of the light-emitting diodes, reflectors, or diffusers, in order to generate a light distribution which is highly similar to a conventional incandescent filament. In addition, a construction of a conventional incandescent lamp can thus be maintained using simple means. Therefore, for example, in vehicle headlights, LED illumination can already be achieved by replacing the headlight lamp instead of having to replace the entire headlight. In addition, because the optical waveguides themselves do not emit light into space, particularly precise simulation of a light distribution of a conventional incandescent lamp can be achieved. This is important in particular in vehicle lamps, which must fulfill a precisely defined light emission pattern. In addition, by way of the use of the light scattering body which is different from the optical waveguide, complex shaping of the optical waveguide (e.g., having a coiled section), which is installation-intensive, susceptible to failure, and less effective, can be omitted.

In one embodiment, the light scattering body is implemented as a compact body without opposing surfaces. This increases an effectiveness of the lamp, for example, in comparison to a coiled embodiment. The compact embodiment also allows a light emission surface which is particularly spatially uniform.

In still another embodiment, the light scattering body is implemented as a body having a cylindrical basic shape. This shape is at least approximately similar in its external dimensions to a shape of a conventional incandescent filament. Adaptations of conventional lamp designs to the semiconductor incandescent lamp retrofit lamp may thus be reduced to a small degree, and with improved homogeneity of the emitted light in comparison to a coiled embodiment.

However, the light scattering body may also be embodied as cuboid, in the form of a ring sector, in the form of a polygon traverse, etc.

In one refinement, the semiconductor incandescent lamp retrofit lamp has at least one optical waveguide, which leads from a respective light scattering body to at least one semiconductor light source assigned to the respective light scattering body. Therefore, light from more than one semiconductor light source can also be coupled into one light scattering body. This allows amplified brightness of the light scattering body, in particular in the case of similar semiconductor light sources. Alternatively or additionally, a color of the light emitted from the light scattering body can thus also be intentionally changed, in particular if the coupled light is of a different color, for example, by the use of semiconductor light sources emitting in different colors.

In still another embodiment, the semiconductor incandescent lamp retrofit lamp respectively has (precisely) one optical waveguide, which leads from a respective light scattering body to (precisely) one semiconductor light source assigned to the respective light scattering body. Precisely one semiconductor light source is thus assigned to each light scattering body. A particularly simple and compactly constructed semiconductor incandescent lamp retrofit lamp is thus provided.

In one further embodiment, the at least one optical waveguide has at least one optical fiber, e.g., a glass fiber. Effective light conduction may thus be achieved with a small space requirement (little shading) and a low installation effort. Alternatively, for example, an optical waveguide rod can be used.

Furthermore, in one embodiment, the semiconductor incandescent lamp retrofit lamp has precisely one light scattering body. This semiconductor incandescent lamp retrofit lamp is suitable in particular for replacing conventional incandescent lamps having an incandescent filament, e.g., a household incandescent lamp or a motor vehicle headlight lamp of the type H7 for automobiles or H11 for motorcycles.

In one alternative embodiment, the semiconductor incandescent retrofit lamp has two light scattering bodies. This semiconductor incandescent lamp retrofit lamp is suitable in particular for replacing conventional incandescent lamps having two incandescent filaments, for example, a motor vehicle headlight lamp of the type H4. However, the semiconductor incandescent lamp retrofit lamp may also have more than two light scattering bodies, for example, to simulate an equal number or a smaller number of incandescent filaments.

In another embodiment, the at least one light scattering body is implemented as a plastic body. It may be produced simply and in manifold geometric forms. These advantages may be achieved in particular using a PMMA (polymethyl methacrylate) body. PMMA is additionally highly resistant with respect to a radiation stress by light. However, for example, a use of a light scattering body made of glass, etc., is also possible.

The light scattering property can be caused in many ways. In particular, a surface of the light scattering body may be roughened. Alternatively, the surface may be covered with optically active decoupling elements, e.g., microlenses. Very generally, the surface can optionally have a light-decoupling structuring (optionally including the roughening). Optionally or additionally, the body may consist of a translucent material, for example, have light scattering bodies as a filler material, and/or have gas-filled inclusions. The light scattering body may also have an at least partially wavelength-converting, diffusely emitting phosphor as a scattering material.

In addition, a phosphor arranged on the light scattering body may be implemented such that it converts light emitted from a semiconductor light source, for example blue light, or ultraviolet radiation emitted from a semiconductor light source, into white light. The phosphor may be arranged as a coating on the light scattering body or phosphor particles can be embedded in the material of the light scattering body, for example. The phosphor can also be a mixture made of a plurality of phosphors. Alternatively, such a phosphor or such a phosphor mixture may also be arranged on the semiconductor light source, so that the light coupled into the light scattering body is already white light.

In still another embodiment, the at least one light scattering body is arranged at a position which at least substantially corresponds to a position of an incandescent filament of a conventional incandescent lamp to be replaced. Adaptations of conventional lamp designs to the semiconductor incandescent lamp retrofit lamp may thus also be reduced to a small extent.

In still a further embodiment, the at least one light scattering body has an at least substantially equal maximum external dimension as an incandescent filament of a conventional incandescent lamp to be replaced. This is a further advantageous measure for reducing adaptations of conventional lamp designs to the semiconductor incandescent lamp retrofit lamp to a small extent.

Furthermore, in one embodiment, the at least one light scattering body is inserted into a respective socket. This allows a simple installation of the light scattering body. In addition, the at least one optical waveguide may thus be installed separately from the at least one light scattering body, which may be advantageous with respect to production and additionally allows a flexible choice among different light scattering bodies without requiring an adaptation of the further components of the lamp.

The socket is a terminal socket for a particularly simple installation.

In addition, in one embodiment, a bulb of the semiconductor incandescent lamp retrofit lamp substantially corresponds to a bulb of a conventional incandescent lamp to be replaced, in particular with respect to its shape. A conformity of the shape to a conventional incandescent lamp is thus assisted.

In still another embodiment, at least one semiconductor light source includes or is at least one light-emitting diode. Light-emitting diodes are cost-effective, have a high luminous flux, are compact, and are simple to operate. Alternatively, the semiconductor light source may also have a semiconductor laser, in particular a laser diode, however.

In general, the at least one semiconductor light source preferably includes at least one light-emitting diode. If a plurality of light-emitting diodes are provided, these can illuminate in the same color or in different colors. A color may be monochromic (e.g., red, green, blue, etc.) or multichromic (e.g., white). A plurality of light-emitting diodes may generate a mixed light; for example, a white mixed light. The at least one light-emitting diode may contain at least one wavelength-converting phosphor (conversion LED). The at least one light-emitting diode may be provided in the form of at least one individually housed light-emitting diode or in the form of at least one LED chip. A plurality of LED chips may be installed on a shared substrate ("submount"). Instead of or in addition to inorganic light-emitting diodes, e.g., based on InGaN or AlInGaP, in general organic LEDs (OLEDs, e.g., polymer OLEDs), are also usable. Alternatively, the at least one light source may have, for example, at least one diode laser.

In still another embodiment, a driver for powering the at least one semiconductor light source is housed in a base of the semiconductor incandescent lamp retrofit lamp. A particularly compact semiconductor incandescent lamp retrofit lamp is thus made possible.

In addition, in one embodiment, the semiconductor incandescent lamp retrofit lamp is a vehicle lamp, in particular a headlight lamp. This allows an LED illumination in vehicles (automobiles, motorcycles, aircraft, ships, etc.) without replacing the headlight, specifically by simply replacing the lamp.

In one special embodiment, the semiconductor incandescent lamp retrofit lamp is provided for the purpose of replacing a conventional halogen lamp of the H type, in particular of the type H4, H7, and H11. This type of headlight lamp is particularly widespread, so that the semiconductor incandescent lamp retrofit lamp is particularly advantageously usable here. In general, the retrofit lamp according to the disclosure may be implemented such that it replaces a halogen incandescent lamp of the ECE category H1, H3, H4, H7, H8, H9, H11, or H15. The retrofit lamp according to the disclosure may also be designed for such different lighting functions such as, for example, low-beam light, high-beam light, fog light, daytime running light, and navigation light, or for a combination of a plurality of these functions.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which:

FIG. 1 shows a sectional illustration in a side view of an LED halogen lamp retrofit lamp according to the disclosure.

DETAILED DESCRIPTION

The following detailed description refers to the accompanying drawing that show, by way of illustration, specific details and embodiments in which the disclosure may be practiced.

FIG. 1 shows a sectional illustration in a side view of an LED halogen lamp retrofit lamp 1. The LED halogen lamp retrofit lamp 1 is intended for the purpose of replacing a conventional halogen headlight lamp of the H type, of the type H4 here. The halogen lamp retrofit lamp 1 has the external contour of the conventional H4 halogen lamp here, so that a replacement is possible without problems.

The LED halogen lamp retrofit lamp 1 has a base 2, from which, in a rear direction opposite to a longitudinal axis L, three electrical contact pins 3 typical for H4 halogen lamps extend. The base 2 also has a driver housing 5, into which the contact pins 3 lead and in which a driver 6 is housed. The driver 6 receives the electrical signals fed via the contact pins 3 and converts these into electrical signals for operating or powering two semiconductor light sources in the form of light-emitting diodes 7 and 8 here.

The light-emitting diodes 7 and 8 are also housed in the base 6 and are separately drivable by the driver 6. The light-emitting diodes may be light-emitting diodes which emit white light in particular. Optical waveguides in the form of optical fibers 11 or 12 adjoin corresponding light emission surfaces of the light-emitting diodes 7 and 8 via corresponding coupling units or 10, respectively. The optical fibers 9 and 10 substantially relay all of the light emitted from the light-emitting diodes 7 and 8.

The base is adjoined toward the front in the direction of the longitudinal axis L by a framework 13, which has two terminal sockets 14, 15 arranged spaced apart at least approximately on the longitudinal axis. The terminal sockets 14, 15 are located approximately at the position at which the incandescent filaments are located in conventional H4 halogen lamps. The terminal sockets 14, 15 are each used to accommodate one light scattering body 16 and 17. Light can be coupled from the light-emitting diode 7 into the light scattering body 16 via the optical fiber 11 and light may be coupled from the light-emitting diode 8 into the light scattering body 17 via the optical fiber 12. The optical fibers 11 and 12 run close to or on the framework 13.

The light scattering bodies 16 and 17 are implemented as roughened, cylindrical bodies made of glass or plexiglass (PMMA) and scatter the light coupled therein in a highly unoriented manner.

The light scattering bodies 16 and 17 are protected by a bulb 18, whose shape here corresponds to the shape of a typical H4 bulb. The bulb 18 may consist of transparent or translucent plastic or glass and has a mirrored front region 19. The light scattering bodies 16 and 17 are substantially located at the position at which the incandescent filaments are located in conventional H4 halogen lamps and are at least approximately similar to the incandescent filaments with respect to a maximum external dimension or dimension of the external contour (e.g., length and/or diameter). By way of this position and shape similarity between the light scattering bodies 16 and 17 and the incandescent filaments and by way of the diffuse light scattering of the light scattering bodies 16 and 17, a light emission pattern which is highly similar in comparison to the incandescent filaments of the conventional halogen headlight lamp is thus generated by the LED halogen lamp retrofit lamp 1. The LED halogen lamp retrofit lamp 1 may thus be used without further adaptations as a replacement for conventional H4 halogen headlight lamps. In particular, a cover cap 4 already used in the conventional H4 halogen lamp can be used further substantially without changes. The cover cap 4 ensures that the light emitted from the light scattering body 17 is only emitted in a half space (on the right here). The cover cap 4 is thus also not used for the purpose of aligning the light emission characteristic of the light scattering body 17 per se (which is not necessary), but rather to shape the light emission, which already approximates an incandescent filament, so it is designed further for the application.

Of course, the disclosure is not restricted to the exemplary embodiment shown.

The LED halogen lamp retrofit lamp can thus also be used to replace other incandescent lamps, for example, conventional household incandescent lamps or other halogen headlight lamps of the H type. For example, the LED halogen lamp retrofit lamp may be designed to replace a conventional H7 lamp, which only has one incandescent filament. The corresponding LED halogen lamp retrofit lamp then also only needs to have one light-emitting diode, one optical waveguide, and one light scattering body.

However, it is also possible to couple light of a plurality of light-emitting diodes into at least one of the light scattering bodies. A brightness may thus be increased, or light of different colors (corresponding to light of light-emitting diodes emitting in different colors) may be emitted.

The light-emitting diode(s) may be dimmed by the driver in particular, so that a brightness emitted from the light scattering body may be adjusted.

The use of a compact, in particular cylindrical light scattering body instead of an incandescent filament, in particular at the position thereof and in particular having the external dimensions thereof, may also represent disclosure independently of a type of the at least one optical waveguide (with or without implementation as a light scattering body).

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE NUMERALS

1 LED halogen lamp retrofit lamp
2 base
3 contact pin
4 cover cap
5 driver housing
6 driver
7 light-emitting diode

8 light-emitting diode
9 coupling unit
10 coupling unit
11 optical fiber
12 optical fiber
13 framework
14 terminal socket
15 terminal socket
16 light scattering body
17 light scattering body
18 bulb
19 mirrored front region of the bulb
L longitudinal axis

The invention claimed is:

1. A semiconductor incandescent lamp retrofit lamp in a form of a vehicle headlight lamp, comprising:

a bulb disposed above the base of the semiconductor incandescent lamp retrofit lamp;

at least one semiconductor light source housed within a base of the semiconductor incandescent lamp retrofit lamp, two light scattering bodies disposed above the at least one semiconductor light source, a framework disposed above the at least one semiconductor light source and adjoined to the base in the direction of a longitudinal axis of the incandescent lamp retrofit lamp; said framework having two sockets arranged and spaced apart along the longitudinal axis; wherein the sockets accommodate one of said light scattering bodies, and at least one optical fiber adjoined to a corresponding light emission surface of the at least one semiconductor light source, which leads from to the light scattering bodies to the at least one semiconductor light source, and into which light of the at least one semiconductor light source can be coupled therein, wherein each of the two light scattering bodies is a roughened substantially cylindrical body made of glass or polymethyl methacrylate(PMMA) to diffusely emit light supplied from the at least one semiconductor light source by way of the at least one optical fiber through the bulb, and wherein a driver for powering the at least one semiconductor light source is housed within the base.

2. The semiconductor incandescent lamp retrofit lamp as claimed in claim 1, having an additional fiber, which leads from a respective light scattering body to a semiconductor light source assigned to the respective light scattering body.

3. The semiconductor incandescent lamp retrofit lamp as claimed in claim 1, wherein the sockets are terminal sockets.

4. The semiconductor incandescent lamp retrofit lamp as claimed in claim 1, wherein at least one semiconductor light source comprises at least one light-emitting diode.

5. The semiconductor incandescent lamp retrofit lamp as claimed in claim 1, wherein a cover cap partially surrounding one of the light scattering bodies is fixed to the framework.

* * * * *